US006272298B1

(12) United States Patent
Yamaguchi et al.

(10) Patent No.: US 6,272,298 B1
(45) Date of Patent: Aug. 7, 2001

(54) DEVELOPER CARTRIDGE

(75) Inventors: Jun Yamaguchi, Ikoma; Toshio Nishino, Yamatokoriyama; Yoshinori Otsuka, Tenri; Yasuyuki Ishiguro, Higashiosaka; Hiroshi Tanisawa, Nara; Tsutomu Nagata, Hirakata, all of (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 09/522,073

(22) Filed: Mar. 9, 2000

(30) Foreign Application Priority Data

Mar. 31, 1999 (JP) ..... 11-090526

(51) Int. Cl.[7] ..... G03G 15/08
(52) U.S. Cl. ..... 399/106; 399/262
(58) Field of Search ..... 399/120, 262, 399/258, 106; 222/DIG. 1, 541.1, 541.9

(56) References Cited

U.S. PATENT DOCUMENTS

| | | | | |
|---|---|---|---|---|
| 4,456,154 | | 6/1984 | Herriman . | |
| 4,491,161 | * | 1/1985 | Tamura et al. | 141/364 |
| 4,583,660 | * | 4/1986 | Barre et al. | 222/1 |
| 4,895,104 | * | 1/1990 | Yoshino et al. | 399/106 |
| 5,018,560 | * | 5/1991 | Tsukamoto | 141/364 |
| 5,027,156 | * | 6/1991 | Kobayashi | 399/106 |
| 5,640,651 | | 6/1997 | Katoh et al. . | |
| 5,761,589 | | 6/1998 | Kido et al. . | |
| 5,794,109 | | 8/1998 | Ota et al. . | |
| 5,946,530 | | 8/1999 | Tsuji et al. . | |
| 6,049,689 | | 4/2000 | Ishii et al. . | |
| 6,094,550 | | 7/2000 | Kido et al. . | |

FOREIGN PATENT DOCUMENTS

| | | | |
|---|---|---|---|
| 854395 | | 7/1998 | (EP) . |
| 62-231976 | * | 10/1987 | (JP) . |
| 3-71166 | | 3/1991 | (JP) . |
| 371166 | | 3/1991 | (JP) . |
| 371167 | | 3/1991 | (JP) . |
| 371168 | | 3/1991 | (JP) . |
| 6-33158 | | 4/1994 | (JP) . |
| 8-115043 | * | 5/1996 | (JP) . |
| 10-104923 | | 4/1998 | (JP) . |

* cited by examiner

*Primary Examiner*—Robert Beatty

(57) ABSTRACT

A developer cartridge capable of being fitted to the toner replenishing opening of a developer storage hopper has a sealing member for sealing the toner therein that is bonded to the rim of its replenishing opening to be opposed to the opening of the developer storage hopper. The bottom face of this developer cartridge which constitutes the bottom for supporting the toner stored therein is inclined upwards in the stripping direction of the sealing member, whereby the supplied amount of the toner at the stripping start of the sealing member is regulated when the sealing member is stripped so that the toner can be uniformly supplied across the full length of the developer storage hopper with respect to the stripping direction of the sealing member.

12 Claims, 9 Drawing Sheets

DEVELOPER CARTRIDGE

BACKGROUND OF THE INVENTION (1) Field of the Invention

The present invention relates to a developing unit for use in an image forming apparatus such as a laser printer, copier, facsimile machine etc., in order to replenish the developer for image development to the developing vessel as a part of the developing unit and in particular relates to a structure of a developer cartridge for replenishing the developing unit with the developer when it is used up.

(2) Description of the Prior Art

An image forming apparatus such as a laser printer, copier, facsimile machine, etc., utilizing the electrophotographic technique, has an image forming portion for forming a desired image on a sheet for recording. In this image forming portion, the surface of a photoreceptor as an image bearer is uniformly electrified with charge of a particular polarity and then is illuminated with an optical image so as to form a static latent image corresponding to the image. For the purpose of visualizing this static latent image, the image forming portion includes a developing unit and other components. The developing unit is configured of a developing vessel holding a developer and having a developing roller etc., for supplying the developer to the developing position where the developing roller opposes the photoreceptor. Further, since the developer in the developing vessel is consumed, a toner replenishing device for supplying the developer, or for instance, a toner, to the developing vessel as necessary is arranged adjacent to the developing vessel. When the toner in this toner replenishing device is used up, a developer cartridge is set for replenishing so that the toner contained in the cartridge is supplied.

The above developer cartridge is configured of a container box having one side open and containing the developer therein with its opening attached with a removable sealing member so as to package the developer in the container box. In this configuration, a door provided for the opening for replenishment of the toner replenishing device is opened and then the developer cartridge is fitted to the opening so that the sealing member opposes the opening of the door. In this position, when the sealing member is removed, the stored developer is supplied the toner replenishing device through the opening.

According to the developer cartridge having the above configuration, when a cartridge body 100 in FIG. 1 is set to the opening of a developer storage hopper 101 of the toner replenishing device as shown in FIG. 1 and a sealing member 102 is stripped from the cartridge body 100 side, developer (toner) T inside cartridge 100 falls into hopper 101. At this moment, toner T fills hopper 101 sequentially in the order of unsealing of the opening as sealing member 102 is peeled off.

Resultantly, the replenishing of toner T at the area from which sealing member 102 is peeled first differs from the replenishing of the toner at the area where the sealing member is last removed. More illustratively, due to the fluidity of toner T, a large amount of toner T, as indicated by region E1, falls and is supplied to the hopper at the stripping start area of sealing member 102. On the contrary, at the stripping end area of sealing member 102 , a smaller amount of toner is supplied as indicated by region E2.

With this replenished state, if toner T being supplied in hopper 101 is conveyed to the developing vessel, a greater amount of toner is fed at the region where a large amount of toner is replenished in hopper 101 while the replenishing amount of the toner will inevitably be lowered at the stripping end of sealing member 102. To deal with this, an agitator 103 or the like is arranged in order to avoid uneven distribution of the toner being provided to hopper 101, toner aggregation and other defects so as to uniformly distribute toner T after replenishment. However, it is not possible to make the distribution of the toner in the longitudinal direction uniform immediately, so stable replenishment of the toner to the developing vessel cannot be expected before this is completed.

Resultantly, it is impossible to carry out development of uniform density because of imbalance of the distribution of the toner amount in the developing unit, and hence this may cause image defects.

To deal with this, Japanese Utility Model Application Laid-Open Hei 6 No.33158 discloses a configuration as shown in FIG. 2, in which partitions 104 are provided to divide the body of a developer cartridge 100 into sections of the same width, wherein each section, separated by partitions 104, is filled up with the same amount of toner T. This configuration eliminates variations in the supplied amount of toner at the edge area as shown in FIG. 1.

However, it is necessary to provide each partitioned section with the same amount of toner when it is manufactured, so this configuration needs a careful packaging operation. Further, since partitions 104 for partitioning the body of cartridge 100 are needed, resulting in high manufacturing cost for cartridge 100 body.

There is another configuration, which is disclosed in Japanese Patent Application Laid-Open Hei 10 No.104923 in which a vibrating member is provided on the developer storage hopper 100 side so that the vibrating member is activated during replenishing to thereby make the developer that fills developer storage hopper 100 uniform. This configuration is advantageous in that the supplied developer can be uniformly leveled off, but needs a vibrating member and a circuit for driving the vibrating member in linkage with the replenishing operation of the developer, leading to a rise in cost.

On the other hand, Japanese Patent Application Laid-Open Hei 3 No.71166 discloses a developer cartridge 100 of which the shape of the container box is manipulated so the toner can be supplied in a greater amount on the side from which the sealing member starts to be stripped and the charged amount of toner is continuously decreased in the stripping direction, as in FIG. 1. With a developer cartridge having such a shape, a further greater amount of the developer will be supplied at the stripping start area while a markedly lowered amount of developer will be supplied at the stripping end area, as is apparent from the consideration of the toner's fluidity. As a result, when the developer is replenished to the developing vessel having a developing roller, the replenished amount of the developer becomes extremely large at one end and extremely small at the other end with respect to the direction of the rotary axis of the developing roller.

This causes a marked imbalance in the amount of the developer replenished to the developer vessel, which leads to variations in developing density, etc. along the direction of the rotary axis, only resulting in markedly awkward development.

SUMMARY OF THE INVENTION

In view of the above problems, it is therefore an object of the present invention to provide a developer cartridge which has a developer, confined therein by a sealing member, that replenishes a developer storage hopper for replenishing the developer, as required, into a developing vessel having a developing roller, with the developer when the developer in the hopper is used up, and is configured so that the developer can be supplied into the hopper uniformly with respect to the stripping direction of the sealing member when the sealing member is stripped for replenishing.

It is another object of the present invention to provide a developer cartridge of a simple configuration which allows substantially uniform provision of the developer along the stripping direction of a sealing member without having a special configuration.

In order to achieve the above objects, the present invention is configured as follows:

In accordance with the first aspect of the present invention, a developer cartridge for holding a developer to be supplied into a developer storage hopper, includes: a container box having an open face which is fitted to a replenishing opening of the developer storage hopper and is filled up with a developer; and a sealing member removably bonded to the rim of the opening of the container box to seal the developer filled in the container box, wherein the container box is detachably set to the developer storage hopper with the sealing member opposed to the replenishing opening of the developer storage hopper, and is characterized in that the container box is shaped so that a reduced amount of the developer is supplied from the developer cartridge at the stripping start area of the sealing member and an increasing amount of the developer is supplied in the stripping direction.

In accordance with the second aspect of the present invention, the developer cartridge having the above first feature is characterized in that the container box thereof has a bottom face that is located opposite to the sealing member and is inclined upwards so that the height thereof is lowest at the stripping start point of the sealing member and gradually increases in the stripping direction.

In accordance with the third aspect of the present invention, the developer cartridge having the above second feature is characterized in that the angle of inclination $\theta_1$ of the bottom face of the container box thereof is set to fall within the range specified as follows:

$$\theta/2 \leqq \theta_1 < \theta,$$

where $\theta$ is the angle of repose of the developer to be charged.

In accordance with the fourth aspect of the present invention, a developer cartridge for holding a developer to be supplied into a developer storage hopper, includes: a container box which has an opening which is fitted to a replenishing opening of the developer storage hopper and is filled up with a developer; and a sealing member removably bonded to the rim of the opening of the container box to seal the developer filled in the container box, wherein the container box is detachably set to the developer storage hopper with the sealing member opposed to the replenishing opening of the developer storage hopper, and is characterized in that the developer cartridge is fitted to the developer storage hopper with the center of the container box thereof shifted relative to the center of the developer storage hopper in the stripping direction.

In accordance with the fifth aspect of the present invention, the developer cartridge having the above first or fourth feature is characterized in that the end face of the container box thereof at the stripping start side of the sealing member and the end face thereof at the stripping end side of the sealing member are inclined in the stripping direction of the sealing member.

In accordance with the sixth aspect of the present invention, the developer cartridge having the above fifth feature is characterized in that the angle of inclination $\theta_2$ of the end faces of the container box thereof at the stripping start and end sides of the sealing member is set substantially equal to the angle of repose $\theta$ of the developer to be supplied.

In accordance with the seventh aspect of the present invention, the developer cartridge having the above sixth feature is characterized in that the dimensions of the developer cartridge satisfy the following relationship:

$$d_2 \times \sin \theta_2/2 \leqq d_1 \leqq 3 \times d_2 \times \sin \theta_2/2,$$

where $d_1$ is the distance by which the container box thereof is shifted relative to the developer storage hopper in the striping direction of the sealing member, $d_2$ is the depth of the developer storage hopper and $\theta_2$ is the angle of inclination of the end faces of the container box thereof at the stripping start and end sides of the sealing member.

In the above first configuration, since a reduced amount of the developer is supplied at the stripping start area of the sealing member, an excessive amount of the developer will not be provided into the hopper, even when taking into account the affect due to the fluidity of the developer. Therefore, by this configuration, it is possible to supply the developer in amounts gradually increasing in the stripping direction of the sealing member, hence it is possible to eliminate the shortage of replenishing of the developer at the stripping end area, thus realizing uniform replenishing across the full length of the hopper.

Next, one example of the above second configuration is one shown in FIG. 3. In this configuration, a lowered amount of the developer (T) is supplied at the stripping start area of the sealing member (63) while the amount of developer gradually increases in the stripping direction. As stated above, when a lowered amount of the developer is supplied into the developer storage hopper at the stripping start area, an added amount of the developer will flow into that area due to the fluidity of the developer, compensating for the shortage of the developer. Thus, it is possible to realize uniform replenishing across the full length of the hopper.

Further, setting the angle of inclination $\theta_1$ in accordance with the above third configuration assures an optimal supplied amount of the developer in association with its fluidity. When the developer cartridge is fitted so as to supplied the developer, it is possible to directly supplied it uniformly without any leveling operation of the developer filled therein such as shaking the developer cartridge multiple times horizontally.

According to the developer cartridge having the above fourth configuration, when the sealing member is removed for supplied the developer, the developer flows and falls in the direction opposite to the stripping direction at the stripping start area, and builds up therein. Since the developer cartridge is fitted with its center shifted relative to the center of the hopper, if a large amount of the developer is supplied at the stripping start area of the sealing member, the developer can be charged substantially uniformly. Therefore, even with a developer cartridge having the same structure as the conventional configuration, only the manipulation by the shifted attachment of the cartridge enables substantially uniform supplying of the developer with respect to the stripping direction of the sealing member.

Next, one example of the above fifth configuration is a developer cartridge (65) having a configuration shown in FIG. 9. This configuration makes it possible to suppress the supplied amount of the developer at the stripping start area of the sealing member (63) and provide an adequate amount of the developer at the stripping end area. Therefore, it is possible to achieve uniform replenishing.

According to the above sixth configuration, the amounts of the developer falling along the developer's angle of repose θ at the stripping start area (A) and at the stripping end area (B) can be made substantially uniform, thus making it possible to achieve uniform replenishing across the full length of the hopper.

According to the above seventh configuration, when, for example, the developer cartridge is set shifted by a distance $d_1$, as shown in FIG. 10B, limited by the above relationship, relative to the developer storage hopper, it is possible to suppress the developer from building up locally in large amounts, even if the developer falls along its angle of repose (θ). Therefore, it is possible to achieve uniform replenishing across the full length of the hopper.

DESCRIPTION OF THE PREFERRED EMBODIMENTS

Figure 3:
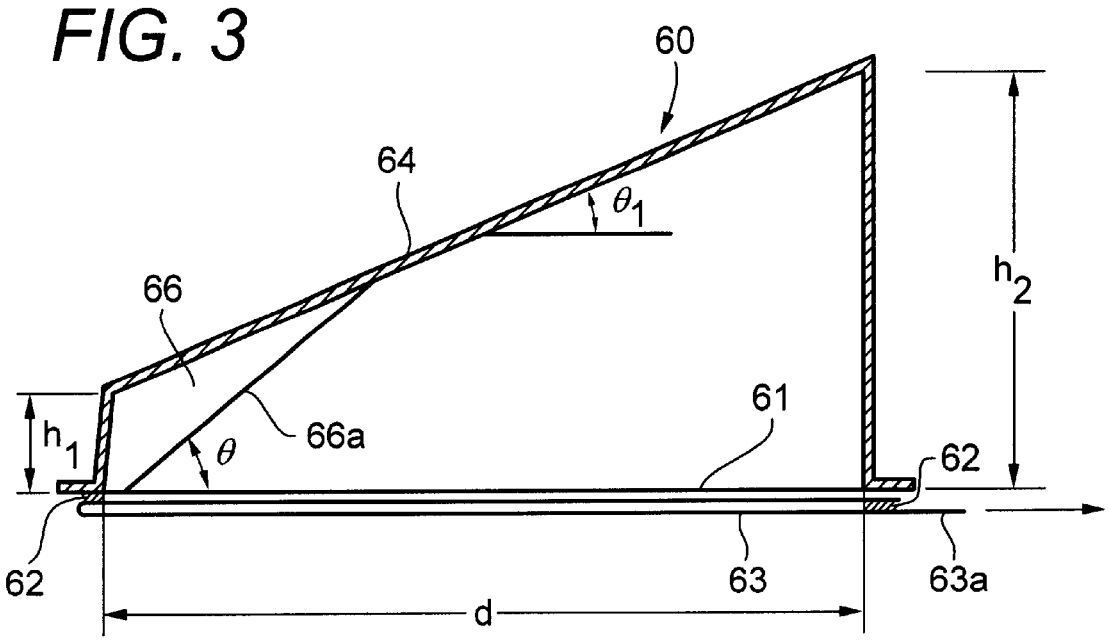
FIG. 3 is a sectional view showing a configuration of the first embodiment of a developer cartridge in accordance with the present invention.
Figure 4:
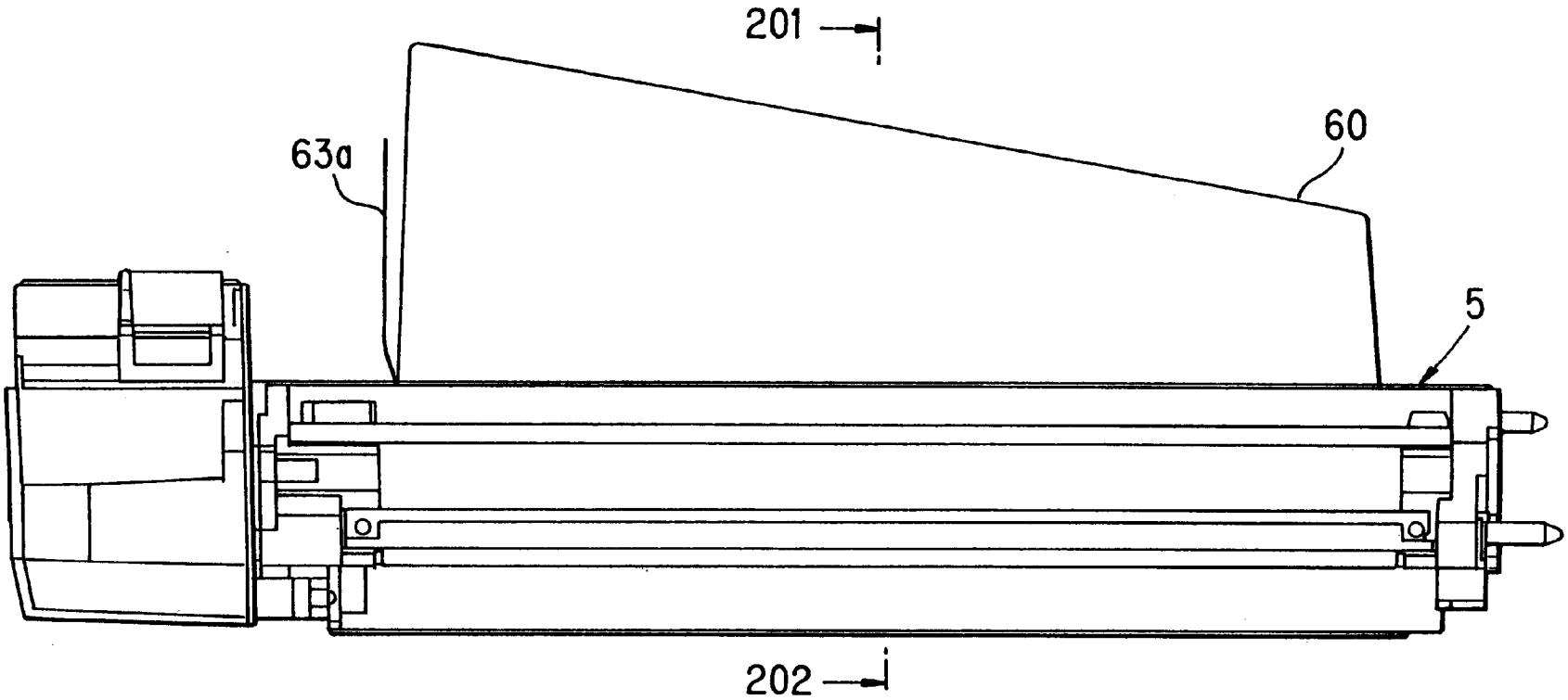
FIG. 4 is a side view showing a state of the developer cartridge shown in FIG. 3 being fitted to a developer storage hopper constituting a developing unit.
Figure 5:
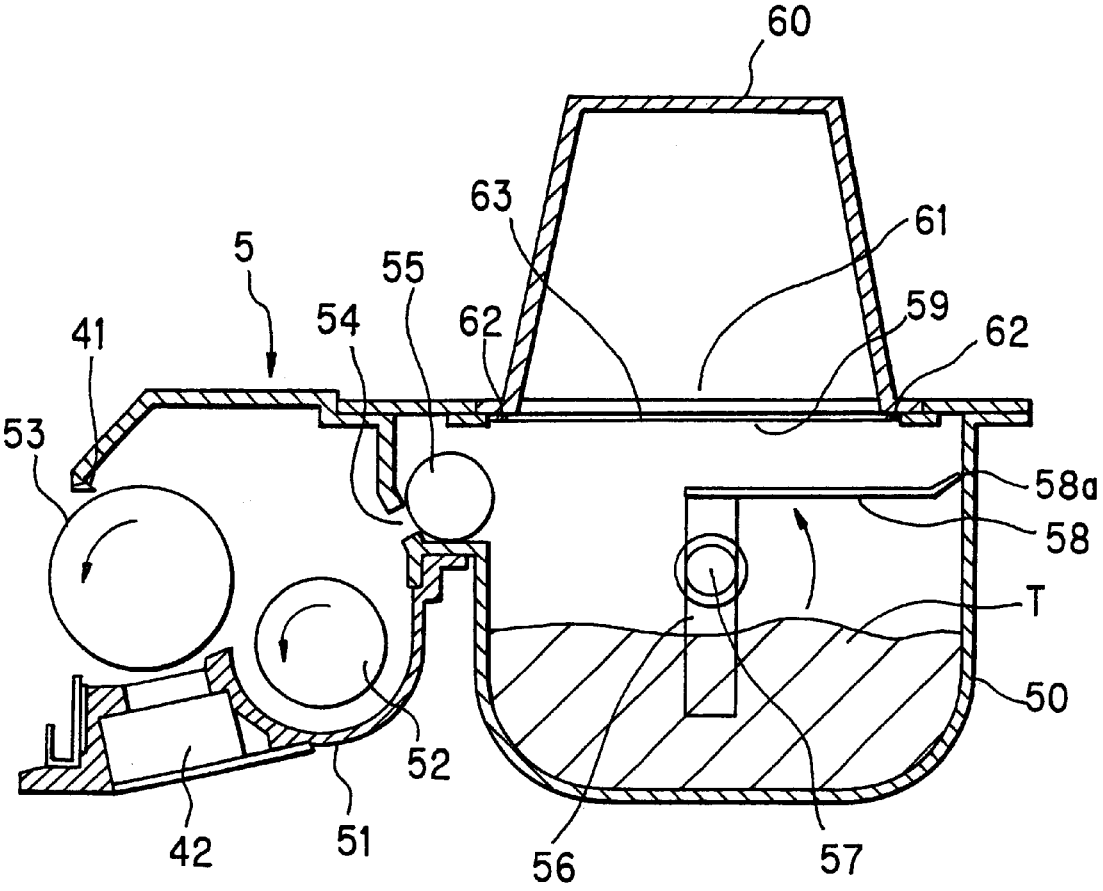
FIG. 5 is a sectional view taken along a line 201-202 in FIG. 4, showing an internal structure of the developing unit when the developer cartridge shown in FIG. 4 is set.
Figure 6:
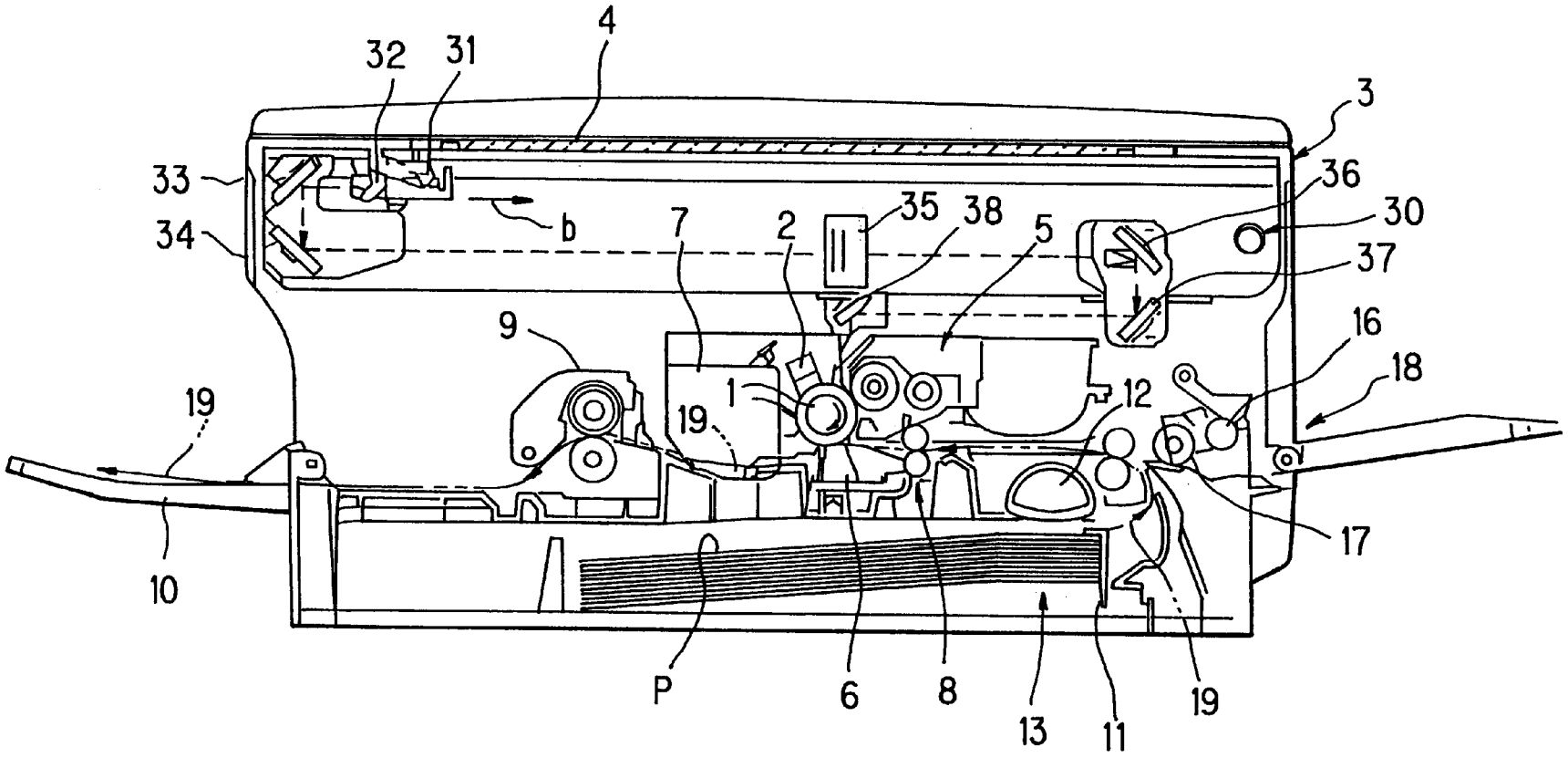
FIG. 6 is a sectional view showing an example of an overall configuration of an image forming apparatus having a developing unit according to the present invention.

The embodiments of the present invention will hereinafter be described in detail with reference to the accompanying drawings. FIG. 3 is a sectional view for illustrating a configuration of the first embodiment of a developer cartridge in accordance with the present invention. FIG. 4 is a side view showing the mounted state of the developer cartridge shown in FIG. 3 being fitted to the developer storage hopper constituting a developing unit according to the present invention. FIG. 5 is a sectional view taken along a line 201-202 in FIG. 4. FIG. 6 is a sectional view showing the internal configuration of a copier as an example of an image forming apparatus having a developing unit according to the present invention to which the developer is supplied by the developer cartridge of the present invention shown in FIG. 3.

To begin with, before description of the first embodiment of a developer cartridge of the present invention, the image forming apparatus shown in FIG. 6 will be described. The developing unit of the present invention can not only be applied to copiers but of course directly applied to the developer cartridges for charging the developer into the developing units of printers, facsimile machines, etc., which use electrophotography.

As shown in FIG. 6, the copier has an image forming portion composed of, in its center, a photoreceptor 1 which rotates in a direction indicated by the arrow, a main charger 2 uniformly charging the photoreceptor surface; a developing unit 5 for developing the electrostatic latent image which has been formed on the photoreceptor by illuminating the image of the original placed on an original table 4 through an optical system 3; a transfer device 6 for transferring the toner image formed on the photoreceptor surface to a sheet which has been fed by a sheet feed device described below; a cleaning unit 7 for removing the leftover toner after transfer; and the like.

Optical system 3 for illuminating photoreceptor 1 with the image of an original includes: a scanner composed of an exposure lamp 31 disposed below original table 4 for illuminating the original and mirrors 32, 33 and 34 which properly reflect the reflected light from the original; a lens 35 focusing the reflected light from the original onto the surface of photoreceptor 1; and fixed reflection mirrors 36, 37 and 38 which finally lead the reflected light from the original through a lens onto photoreceptor 1. Accordingly, the first scanner portion composed of mirror 32 and exposure lamp 31 as part of the scanner is made to travel at a uniform speed along original table 4, while the second scanner portion composed of mirrors 33 and 34 is made to travel in the same direction as the first scanner portion but at half the speed of that of the first scanner portion. By this operation, the image of the original can be sequentially exposed slit-wise to light as photoreceptor 1 rotates, making it possible to create a focused image of the original onto the surface of photoreceptor 1.

There is also a configuration in which, instead of optical system 3 of the above configuration, the image of an original is digitally captured by focusing the image via a focusing lens 35 on an image reading device of photoelectric conversion elements, for example, a CCD or the like so that photoreceptor 1 surface is illuminated with a laser beam from a semiconductor laser which is selectively driven and controlled based on the captured image data. This configuration is known as a digital copier. The configuration shown in FIG. 6 is of an analog copier and distinguished from the digital copier.

When the above optical system 3 exposes the photoreceptor to the original image (optical image), a static latent image corresponding to the original image is formed on the surface of photoreceptor 1 which has been uniformly charged by main charger 2. This static latent image is developed in the next step, i.e., developing unit 5, where the developer (toner) as a coloring agent is made to adhere so as to create a visual image.

The developed image (to be referred to hereinbelow as toner image) formed on the surface of photoreceptor 1 is transferred by the action of transfer device 6 to a sheet which is being conveyed as appropriate from the sheet feed device. The sheet has been previously conveyed up to the position of a registration roller 8, and is delivered out by registration roller 8 to the transfer station (image forming station) facing transfer device 6, at the timing synchronized with the rotary movement of photoreceptor 1.

The sheet after transfer is separated from the photoreceptor 1 surface and then is conveyed along the guide surface to heat fixing roller 9. As it passes through heat fixing roller 9, the toner image formed on the sheet is fixed as a permanent image. Thereafter the sheet is discharged onto a sheet output tray 10 which is projected out from the copier body.

Next, the sheet feed device for feeding sheets to registration roller 8 will be described. The sheet feed device includes: a cassette feeder portion 13 which is disposed in the lower part of the copier body and is composed of a sheet feed cassette 11 which can be detachably fitted to the machine body (can be withdrawn to the front side in the drawing) and a sheet feed roller 12 for delivering sheets P accommodated in sheet feed cassette 11; a sheet tray 14 on which a multiple number of sheets P can be placed; and a manual paper feeder 18 composed of a pickup roller 16 over and opposing the tray, a sheet feed roller 17 for separating and feeding the sheet P delivered by pickup roller 16.

In the figure, a reference numeral 19 shows the conveyance path of sheet P fed from the sheet feed device, in particular, from cassette feeder portion 13.

Next, description will be made of the configuration of developing unit 5 according to the present invention and the first embodiment of a developer cartridge for replenishing developing unit 5 with the developer.

The First Embodiment of the Present Invention

As mentioned before, FIG. 3 is a sectional view showing the configuration of a developer cartridge in accordance with the first embodiment of the present invention. In drawings, the developer cartridge of the present invention is mounted to the replenishing opening of hopper 50 as shown in FIG. 5, in order to supply the developer when developer in the developer storage hopper 50 as a part of developing unit 5 is used up. Then a sealing member, which will be described later, is stripped so that the developer provided in the storage portion (container box) of the cartridge is supplied into the hopper.

Referring first to FIG. 5, the configuration of developing unit 5 according to the present invention will be described. Developing unit 5 has a developer storage hopper 50 for storing the developer. This developer storage hopper 50 is arranged adjacent to, and at the side (opposite to the photoreceptor) of, a developing vessel 51 as a part of developing unit 5.

As conventionally known, developing vessel 51 storing the developer in developing unit 5 is provided with a rotatable, agitating roller 52 for agitating and conveying the developer stored therein and a rotatable, developing roller 53 for conveying the developer to the developing area facing the image forming portion shown in FIG. 6, in particular, photoreceptor 1, so as to perform development. The aforementioned toner reserve container or developer storage hopper 50 is arranged adjacent to developing vessel 51.

Though not illustrated, when the developer is comprised of a toner and a carrier, the developing roller 53 is configured of a nonmagnetic, cylindrical sleeve and a magnet assembly having multiple magnetic poles accommodated therein. As the sleeve is rotated counterclockwise as shown in FIG. 5 the developer attracted to the sleeve by the magnetic force of the magnet assembly is conveyed in that direction into the developing area facing photoreceptor 1. A regulating blade 41 is provided at a position halfway to conveyance and is kept away from the sleeve surface in order to limit the amount of the developer adhering to developing roller 53.

Developer storage hopper 50 constituting developing unit 5 of the present invention is a container for storing a developer T to be replenished to developing vessel 51 as required. A supplying port 54 through which the developer, particularly, toner T is supplied is formed between the hopper 50 and the adjacent developing vessel 51. A replenishing roller 55 is rotatably arranged in such a manner that part of the peripheral surface thereof is pressed against the rim of the opening of supplying port 54. These two, the supplying port 54 and replenishing roller 55 constitute the replenishing portion.

Toner replenishing roller 55 is formed of a porous material such as sponge etc. so that a large number of pores can be formed on its peripheral surface to retain toner T to be supplied to developing vessel 51. Therefore, as toner replenishing roller 55 rotates, the roller surface is scraped by the opening rim of supplying port 54 so that toner T retained by toner replenishing roller 55 is scraped off and supplied to developing vessel 51.

In order to supply toner T to toner replenishing roller 55, a rotatable agitator (rotator) 56 is arranged inside developer storage hopper 50. This agitator 56 is rotationally driven on a rotary shaft 57 so as to agitate toner T stored in developer storage hopper 50. This agitator 56 is a type which is conventionally known and has no special configuration.

Briefly referring to structure of this agitator 56, a pair of plates are arranged on both ends (on the front and rear sides in FIG. 3) of rotary shaft 57 with coil springs or the like tensioned therebetween. The coil springs are attached to the ends of the individual plates.

Rotary shaft 57 of agitator 56 is positioned at the approximate center of developer storage hopper 50 as illustrated. Agitator 56 is fixed to this rotary shaft 57, which is rotationally driven. Agitator 56 is attached off-centered on rotary shaft 57.

More specifically, the two plates (on the front side and rear sides) constituting agitator 56 are fixed to rotary shaft 57 so that for each plate the distance from rotary shaft 57 to one end differs from that to the other, forming shorter and longer portions. Attached to the end of the side a shorter distance from rotary shaft 57 of agitator 56 is one end of a conveying sheet 58 of a flexible sheet-like element, which agitates the toner and conveys and pushes toner T to replenishing roller 55. That is, conveying sheet 58 is attached to agitator 56 in such a manner that the fixed portion to agitator 56 becomes closer to the rotary shaft 57 side. Therefore, when rotary shaft 57 is arranged at the center of the plates on both ends of agitator 56, conveying sheet 58 may be attached to agitator 56 so as to be closer to rotary shaft 57.

The distal free end on the side opposite to the fixed part, of conveying sheet 58 is positioned in proximity to or in slight contact with, the rear wall of hopper 50. In order to improve the efficiency of scooping up toner T, the distal part of conveying sheet 58 may be flexed by an angle θ in the rotational direction of agitator 56, forming a toner retainer 58*a* in a contact manner. In particular, the length of conveying sheet 58 is designated so that the distal end of the flexed portion, i.e., toner retainer 58*a* can be placed in proximity to, either in contact or out of contact with, the right-hand inner wall (rear wall) of developer storage hopper 50 on the side opposite to developing vessel 51, when the sheet is positioned as shown in FIG. 5.

A reference numeral 59 in the drawing designates an opening for replenishing through which toner T is supplied into developer storage hopper 50. An openable/closable door is disposed over the opening 59 so that toner T will not scatter outside of hopper 50. When this openable/closable door is opened, a developer cartridge 60 of the present invention can be fitted to the position of opening 59 as shown in the figure.

A reference numeral 42 designates a sensor for detecting the condition of the toner stored in developing vessel 51. This detecting sensor 42 is to detect, for example, the toner concentration in the developer, and outputs a signal indicating resupply of toner T if the toner concentration is equal to or below a predetermined level. In response to the signal, agitator 56 and replenishing roller 55 start to be driven in order to start replenishment so that the toner concentration in developing vessel 51 can be continuously maintained.

Here, the developer may be of a dual component or mono component type. A dual component developer is composed of a carrier and a toner and only the toner is consumed. Therefore, the ratio of the toner to the carrier decreases as development is carried out so that the toner concentration lowers. If a mono component developer is used, the amount of the toner in the developing vessel 51 decreases as the toner is consumed. The aforementioned sensor 42 detects this fact, whereby the amount of the toner having the prescribed properties is always controlled and kept constant.

In developing unit 5 thus configured, if, for example, an unillustrated toner storage detection sensor for detecting the stored amount of toner T is provided inside developer storage hopper 50, the copier will give a message display or a warning etc., for advising the user to resupply toner T when the sensor detects the end or a low level of storage of toner T. Alternatively, if the above sensor is not provided, sensor 42 on the developer vessel side 51 detects the lowering of the toner concentration and releases a command for toner replenishment. In response to this command, toner replenishment is performed. In this case, if the toner concentration still does not recover after a lapse of a predetermined period, it is determined that toner T inside developer storage hopper 50 is depleted. Then, a message is displayed or warning sent advising toner resupply.

For toner replenishing, the openable/closable door on the top of developer storage hopper 50 in FIG. 5 is opened. In this state where opening 59 on the hopper 50 side is exposed, developer cartridge 60 of the present invention is fitted correspondingly to opening 59. Developer cartridge 60 is formed of an integrally molded container box of resin, for example, having one side open as in the conventional configuration. The portion which is open forms an opening through which developer T is charged. Toner T filling the container box is confined by a sealing member 63 in such a manner that the sealing member is removably fixed to the rim of opening 61 of the container or the portion which is open, with a bonding agent or adhesive 62 as shown in the drawing.

This sealing member 63 is arranged as follows. That is, as show in FIG. 3, the sealing member is folded back at the stripping start side (the left end in FIG. 3) and extends to the opposite side forming a pulling tab 63*a*, which can be pulled in the direction indicated by the arrow, whereby the sealing member can be easily stripped from the bonded portion at the rim of opening 61 of developer cartridge 60. Pulling tab 63*a* may be bonded at one site on the exterior of developer cartridge 60 so that the bonding can be removed to allow pulling by the operator.

The container box of developer cartridge 60 of the present invention is configured so that the height h from the opening to the container bottom face (the upper part) 64 on the side opposite to sealing member 63 gradually becomes greater from the stripping start side of sealing member 63 toward the stripping end side, whereby the stored amount of toner is low at the stripping start side and gradually becomes greater toward the stripping end side. In other words, developer cartridge 60 has its bottom 64 extending gently inclined upwards in the direction of stripping. That is, the bottom is inclined upward and rightward from the stripping start position of sealing member 63 when the cartridge is fitted to opening 59 of developer storage hopper 50 in FIG. 3.

Figure 7:
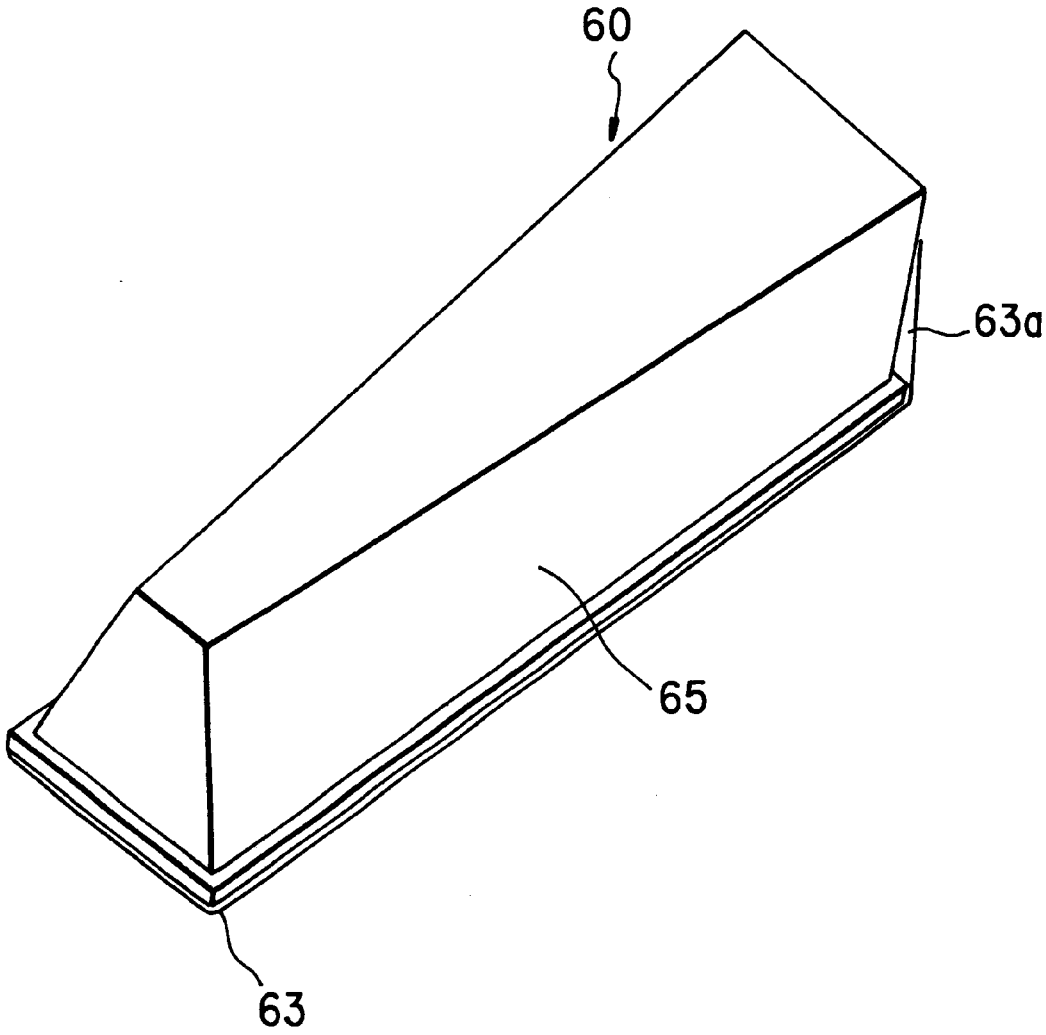
FIG. 7 is a perspective view showing a variational example of a developer cartridge according to the first embodiment of the present invention.

Instead of the configuration shown in FIG. 3, it is possible to configure the container box of developer cartridge 60 in such a manner that both side faces 65 narrow towards each other, tapering toward the stripping start side of sealing member 63 as shown in FIG. 7. This configuration also permits the stored amount of toner to be low at the stripping start side and gradually becoming greater toward the stripping end side. It should be noted, however, that the present invention is not limited to these shapes, and in effect, the developer cartridge 60 may have any configuration which permits the stored amount of the developer to be low at the stripping start side of sealing member 63 gradually becoming greater in the direction of stripping.

The removal of sealing member 63 is effected in the direction of the rotary axes of developer roller 53 f or development and replenishing roller 55 in developing unit 5, as shown in FIG. 4. Therefore, developer cartridge 60 is adapted to be fitted with its length parallel with the direction of the rotary axis of replenishing roller 55 in developer unit 5.

When toner T in developer storage hopper 50 is used up, top opening 59 of developer storage hopper 50 is exposed by opening the openable/closable door in order to replenish the hopper 50 with toner T, and opening 61 of developer cartridge 60 is fitted to opening 59, particularly, sealing member 63 opposing the opening 59, as shown in FIG. 5. When the fitting is completed, pulling tab 63*a* of sealing member 63 is grasped and pulled out in the direction of the arrow in FIG. 3 or leftward in FIG. 4, whereby sealing member 63 is peeled from the folded portion thereof at the other side, i.e., the stripping start end of developer cartridge 60.

During removal, at the stripping start of sealing member 63, a large tension acts and the open portion of opening 61 is gradually enlarged after the start of stripping. Therefore, at the stripping start, the toner T in a hatched area 66 slides down due to the fluidity of toner T provided in the cartridge to replenish developer storage hopper 50, as shown in FIG. 3.

Then, if it is assumed that the sealing member is pulled with the same tension as in the initial stage, the speed of stripping becomes greater as it is removed, so that the slope 66*a* of hatched area 66 gradually becomes closer to the vertical.

As the sealing member 63 is stripped, toner T in the cartridge is supplied into developer storage hopper 50. Accordingly, with the configuration of developer cartridge 60 of the present invention, even taking into account the fluidity of the toner, toner T can be charged without excess as compared to the conventional configuration but can be supplied adequately at the stripping start, so that the toner can replenish developer storage hopper 50 with a substantially uniform level across the longitudinal direction in which sealing member 63 is removed.

When sealing member 63 is completely removed or when it is set at the separated position indicating the end of stripping, developer cartridge 60 may be detached from opening 59 of developer storage hopper 50. Then the openable/closable door is closed so as to tightly confine opening 59.

Thus, when the developer is used up, replenishing of the developer is performed in the above way. For replenishing, if developing unit 5 needs to be detached from the copier in FIG. 6, the unit is taken out. Usually, this can be done by pulling out the unit to the front side in FIG. 6, to allow the openable/closable door of developer storage hopper 50 to be opened. Alternatively, if the top, optical system 3 is lifted away from the upper part of developing unit 5, it is possible to open the openable/closable door of developer storage hopper 50 from above with developing unit 5 mounted in place. This configuration can be realized simply by adapting the whole optical system 3 to rotate about an axis 30 with respect to the copier body.

Another Variational Configuration of the First Embodiment

The index of the fluidity of toner T is represented by the angle of repose (θ). The angle of repose θ of the toner is the angle formed between the horizontal surface and the slope of the heap of unmoving, not flowing toner when the toner is piled on a horizontal surface. In other words, for example, in FIG. 3, in a state where sealing member 63 of developer cartridge 60 is peeled partially so as to allow the flow of toner T charged therein, thus once peeled and stopped, toner T flows and stops at an angle of the inclination, which is defined as the angle of repose θ.

If the angle of repose θ of toner T is small, a large amount of toner is provided due to fluidity or slides downwards. Therefore, in a developer cartridge 60 having a configuration shown in FIG. 3, the angle of inclination $\theta_1$ of bottom face 64 (the angle formed between the horizontal surface and bottom face 64 when the developer cartridge is mounted in place) is set smaller than the toner's angle of repose θ. If the angle of inclination $\theta_1$ is set too small, a large amount of toner may be supplied at the initial stage when sealing member 63 starts to be peeled, and the amount of toner may be decreased gradually as it is stripped.

Therefore, the angle of inclination $\theta_1$ is preferably set equal to or greater than half the angle of repose θ. That is, setting the angle of inclination $\theta_1$ within the range of $\theta/2 \leqq \theta_1 < \theta$ permits substantially uniform supplying of the developer into developer storage hopper 50.

In this case, the height h from the opening to the bottom face 64 of developer cartridge 60 is given as:

$$h_2 \cong h_1 + d \times \sin \theta_1,$$

where $h_1$ is the height at the point from where sealing member 63 starts to be stripped and $h_2$ is the height at a point which is further away by d from the stripping start of sealing member 63. The above height h1 and others are determined from the toner capacity of this developer cartridge 60. Here, d in the above formula, is the distance by which sealing member 63 is peeled from its stripping start and its maximum is the distance from the stripping start to the stripping end as shown in FIG. 3.

Example 1

As described above, the relationship of the angle of inclination $\theta_1$ of bottom face 64 of developer cartridge 60 with respect to the toner's angle of repose θ will be described referring to the experimental results obtained from actual toner replenishing. The experiment of the present invention was carried out using a developer cartridge shaped as shown in FIG. 3 compared to the two conventional examples: the first having a flat bottom face 64 (developer cartridge 100 shown in FIG. 1) and the second having a configuration disclosed in Japanese Utility Model Application Laid-open Hei 6 No.33158 (shown in FIG. 2) in which partitions are arranged to divide the interior of the above first cartridge into sections of the same width.

The angle of repose θ of the toner used was 38° and its volume density was 0.3 g/cc. The toner capacity of the developer cartridge in which the toner was filled was 160 g. The angle of inclination of the bottom face 64 of the container of developer cartridge 60 of the present invention was set at 30°, and the aforementioned amount of toner was provided therein. The conventional developer cartridge having a flat bottom and the same developer cartridge but having three partitions therein were used in which the same toner was uniformly supplied.

Each of the above-mentioned three types of developer cartridges was set to developer storage hopper 50 as shown in FIG. 4 after it was positioned horizontally and shaken five times. In the set position, the sealing member was removed. The result was evaluated by measuring the weight of the toner in each predetermined five equally divided sections (by dividing the length of the cartridge into five equal divisions along the direction of rotary axis 57 of agitator 56). The results of the toner weights for the three cartridges are comparatively shown in FIG. 8.

Figure 8:
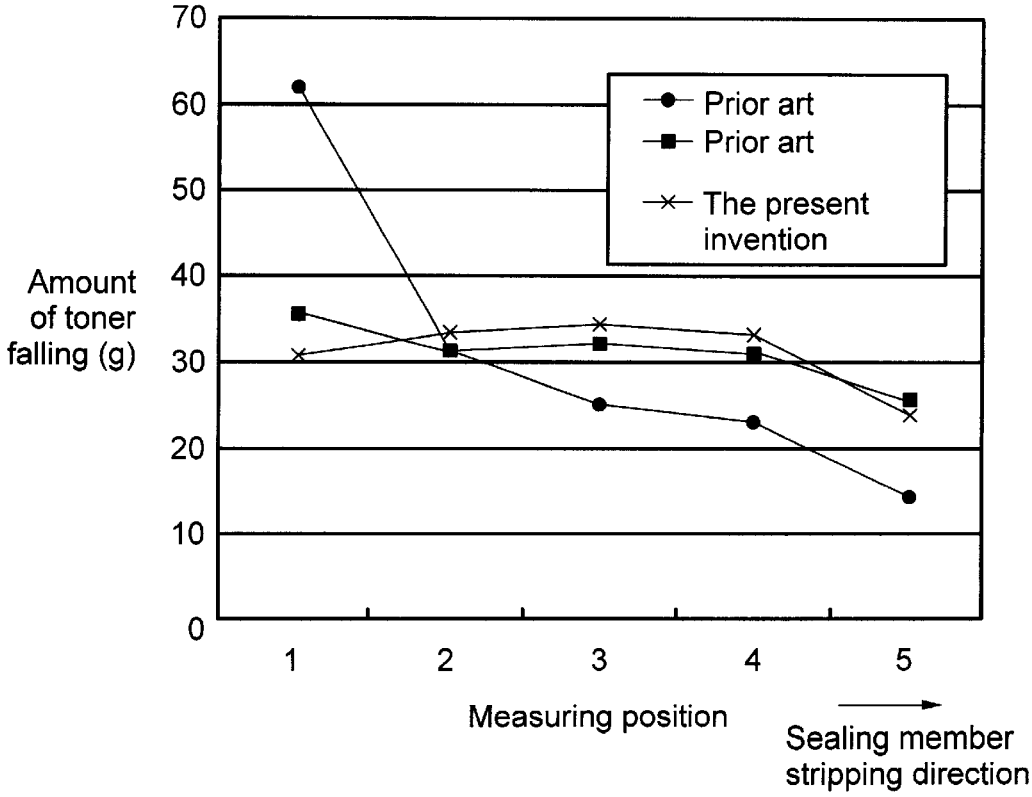
FIG. 8 is a characteristic chart comparatively showing the replenished state of the developer with a developer cartridge of the present invention and the replenished states of the developer with prior art developer cartridges.

As seen from FIG. 8, it was confirmed that the developer cartridge 64 having a configuration of the present invention and the cartridge with partitions can fill the toner uniformly along the full length with respect to the direction of stripping (the direction of axis 67 of agitator 56). However, with the conventional developer cartridge having no partition, the charged amount of toner was markedly high at the stripping start of the sealing member and markedly low at the stripping end of the sealing member.

Figure 2:
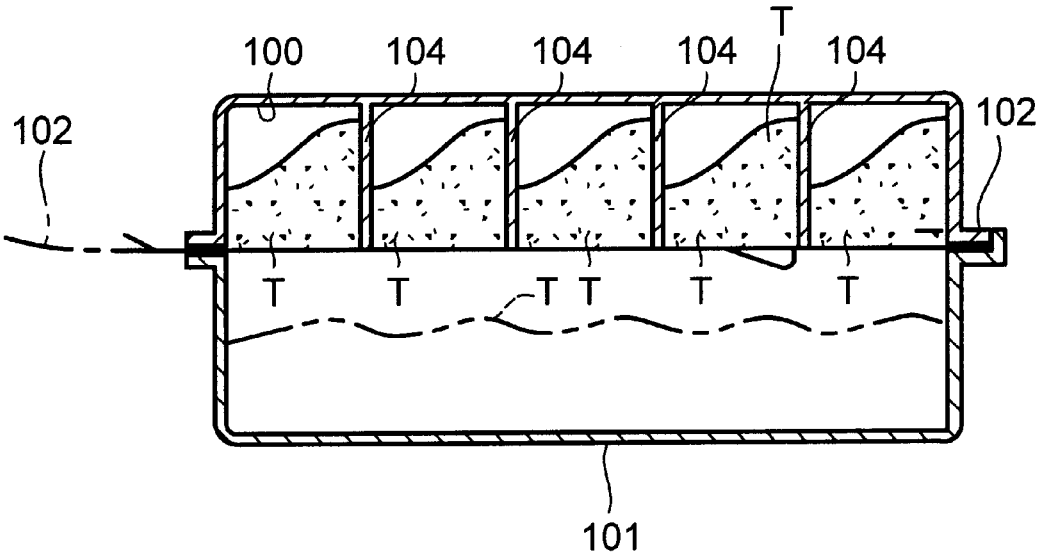
FIG. 2 PRIOR ART
FIG. 2 is a sectional view for illustrating another conventional developer cartridge and a replenished state of the developer when the cartridge is set in a developer storage hopper.

Consequently, developer cartridge 60 of the present invention can replenish developer T substantially uniformly, just as the complicated structure having partitions therein shown in FIG. 2 will do.

Further, according to developer cartridge 60 of the present invention, even if the cartridge is set to developer storage hopper 50 to resupply the toner, without being shaken, or after the cartridge has been placed with its stripping start end of sealing member 63 oriented downwards, the amount of toner can be regulated by the inclined portion of bottom face 64. Therefore, it is possible to inhibit replenishing with an excessive amount of the toner at the stripping start area of sealing member 63 and hence achieve uniform replenishing of the toner. As a result, even if the user forgets to shake developer cartridge 60 before setting it in place, or if such shaking is omitted for simplification, it is possible to achieve uniform replenishing. In this respect, the configuration shown in FIG. 2 can achieve uniform replenishing if it has an increased number of partitions but it cannot achieve uniform replenishing with fewer number of partitions.

In the configuration of developer cartridge 60 of the present invention, since the bottom face 64 alone is inclined (or the side surfaces alone are inclined as shown in FIG. 7), the cost for the metal die for manufacturing the container box of the cartridge body is almost the same as the conventional configuration, needing no extra manufacturing cost. In contrast, in the case of a configuration having partitions therein as shown in FIG. 2, a metal die for forming the partitions is needed or the partitions need to be formed after the manufacture of the container box, hence the manufacturing cost is markedly increased.

Moreover, in the configuration with partitions, it is necessary to supply each partitioned section with the same amount of toner, so this configuration needs a careful packaging operation. Unless equal filling of the developer in each section can be realized, it is no longer possible to expect stable replenishing as shown in FIG. 8.

As an improvement for the configuration with partitions, Japanese Patent Application Laid-Open Hei 7 No.175035 has proposed a configuration in which passage holes are formed through the partitions in order to make the filled amount in each section equal to others. This configuration makes it possible to make the filled amount in each section equal to others by shaking the cartridge body horizontally after the packaging of the developer. However, this configuration needs an additional step to form the passage holes, leading to a rise in cost.

Figure 1:
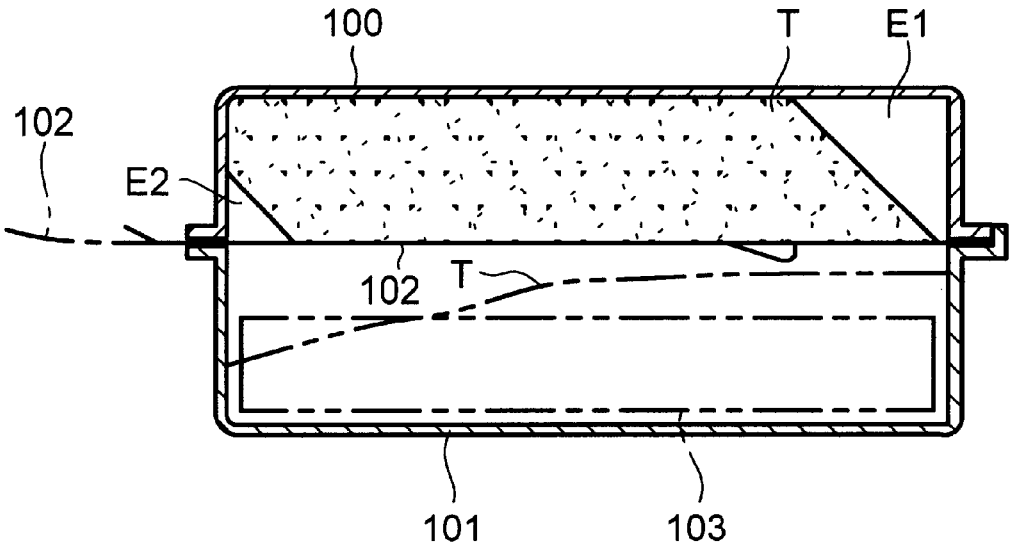
FIG. 1 PRIOR ART
FIG. 1 is a sectional view for illustrating a conventional developer cartridge and its replenished state of the developer when the cartridge is set in a developer storage hopper.

In view of the above consideration, the configuration of developer cartridge 60 of the present invention does not need the above-mentioned extra manufacturing steps and can be manufactured at almost the same cost as in the conventional configuration shown in FIG. 1. Further, for packaging the developer, there is no need to provide an equal amount of developer for each section, which would be needed for the configuration with partitions. Also in the replenishing operation, it is possible to replenish the developer uniformly in a simple manner as in the prior art configuration.

The Second Embodiment of the Present Invention

In the developer cartridge 60 thus configured according to the first embodiment of the present invention, the bottom face 64 of the container box for holding toner T is formed inclined or the side faces 65 thereof are formed inclined.

In the embodiment described hereinbelow, instead of forming inclined bottom face 64 or other inclined faces as stated above, the end face at the stripping start of sealing member 63 (or at the start point for replenishing) is inclined in the stripping direction, taking into account the supplied amount of the toner at the stripping start due to the fluidity of the toner. This configuration makes it possible to suppress the amount of toner supplied compared to the conventional configuration in which the end face at the stripping start is vertical.

Figure 9:
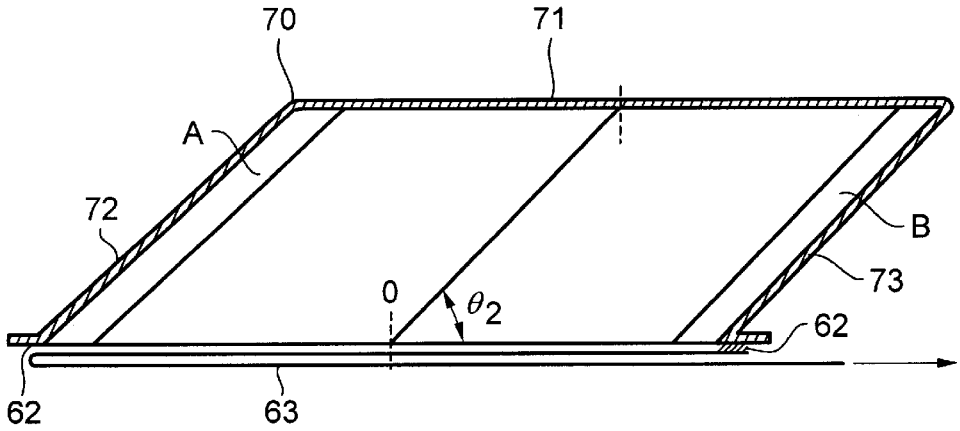
FIG. 9 is a sectional view showing a configuration of the second embodiment of a developer cartridge in accordance with the present invention.

FIG. 9 shows a sectional structure of a developer cartridge 70 in the second embodiment of the present invention. The difference from developer cartridge 60 shown in FIG. 3 is that the bottom face 64 is replaced with a horizontal bottom 71 while the end face designated at 72 from which sealing member 63 starts to be stripped is inclined in its stripping direction. Further, the end face designated at 73 at the stripping end is also inclined in parallel with end face 72 at the start point.

The angle of inclination $\theta_2$ of end face 72 at the stripping start and end face 73 at the stripping end of the above developer cartridge 70 may be theoretically set equal to $\theta$, the angle of repose of toner T as the developer to be filled. The angle may be set within the range of about ±10. That is, the angle of inclination $\theta_2$ may be set in the range of:

$$\theta-10 \leqq \theta_2 \leqq \theta+10$$

for the angle of repose $\theta$ of toner T.

By this arrangement, the supplied amount of toner (hatched area A) falling at the stripping start of sealing member 63 and the supplied amount of toner (hatched area B) falling at the stripping end may become substantially equal to each other. Therefore, when developer cartridge 70 is fitted to developer storage hopper 50 (see FIG. 10A) for toner replenishing, the hopper 50 can be supplied with the toner substantially uniformly in the direction of axis 57 of unillustrated agitator 56 arranged therein.

Figure 10A:
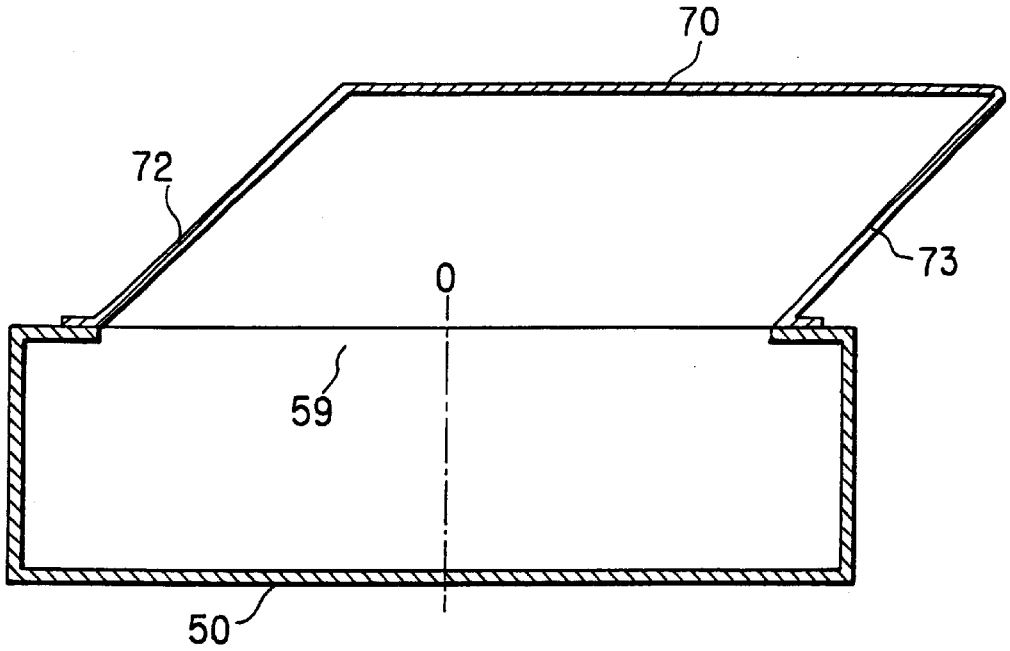
FIGS. 10A and 10B are illustrations showing mounted states of a developer cartridge being fitted to a developer storage hopper according to the second embodiment of the present invention, FIG. 10A showing a state where the cartridge is fitted with its center registered with the hopper's center, FIG. 10B showing a state where the cartridge is fitted with its center shifted in the stripping direction of a sealing member with respect to the hopper's center.

Usually, developer cartridge 70 is mounted to developer storage hopper 50 with its center O, with respect to the stripping direction of sealing member 63, positioned in coincidence with the center O1 of developer storage hopper 50 with respect to the same direction. FIG. 10A shows this state.

A Variational Configuration of the Second Embodiment

When developer cartridge 70 shown in FIG. 9 is set to hopper 50, center O1 of hopper 50 is positioned in coincidence with the center (with respect to the longitudinal direction/the stripping direction of the sealing member) O of developer cartridge 70, as shown in FIG. 10A. In this case, when sealing member 63 is stripped and hence the toner falls and is supplied, part of the toner slides down along the angle of repose $\theta$ and falls in the direction opposite to the stripping direction of sealing member 63 to build up therein. Therefore, the amount of toner at the hopper's end on the stripping start side tends to become slightly greater, though this still falls within the range of the uniform replenishing of the toner as a whole.

For a further improvement, an example will be explained for a more uniform charging of the developer, which is configured by taking into account the filling of developer T falling along the angle of repose $\theta$ as stated above. This can be achieved by only setting developer cartridge 70 to developer storage hopper 50, shifted to some degree in the stripping direction of sealing member 63. This makes it possible to comparatively suppress the buildup of the toner at the hopper's end on the stripping start side even when the toner falls in the direction opposite to the stripping direction at the start position of stripping of sealing member 63, enabling substantially uniform replenishing as a whole.

Figure 10B:
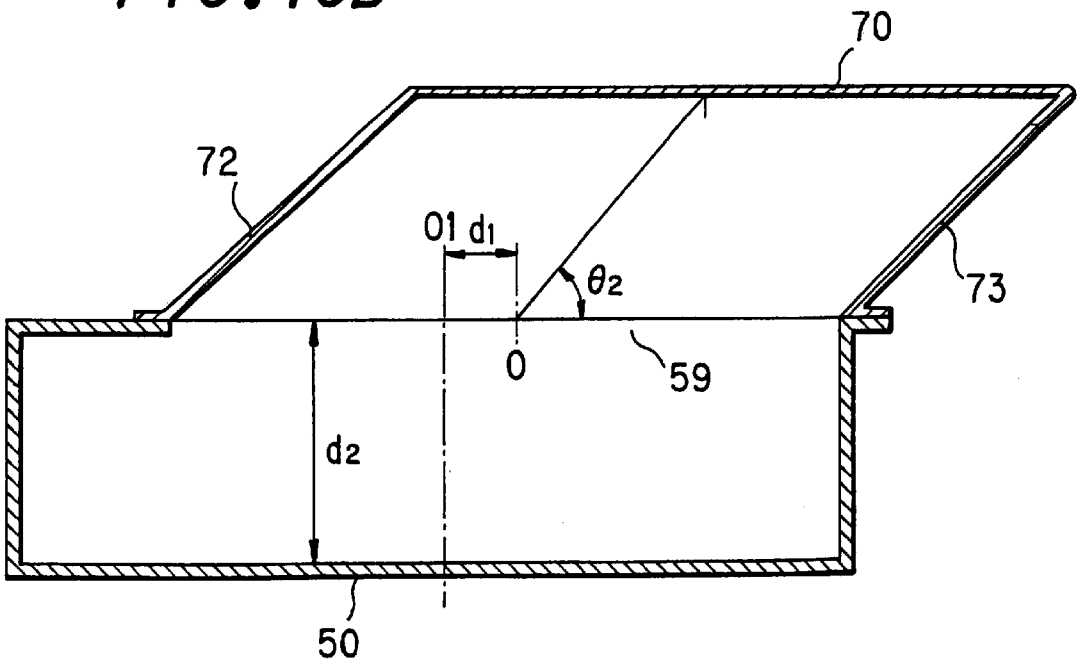

That is, as shown in FIG. 10B, developer cartridge 70 is fitted relative to hopper 50 so that center O of developer cartridge 70 coincides with a point located $d_1$ apart in the stripping direction of sealing member 63, from center O1 of developer storage hopper 50. This shift $d_1$ should be determined depending on the angle of repose $\theta$ of the toner but also depends upon the angle of inclination $\theta_2$ of end face 72 at the start side and other factors of developer cartridge 70. Further, this shift d1 depends on the distance to the bottom of developer storage hopper 50 or depth $d_2$. From consideration of these values, the shift $d_1$ can be set in the following range so as to replenish the developer substantially uniform:

$$d_2 \times \sin \theta_2/2 \leqq d_1 \leqq 3 \times d_2 \times \sin \theta_2/2.$$

With this setting, it is possible to realize uniform replenishing even if the angle of inclination $\theta_2$ of the end face 72 at the stripping start side and the end face 73 at the stripping end side of developer cartridge 70 is not set within the range of ±10° as specified before. The results as to the above configurations will be shown in example 2 hereinbelow.

Example 2

Now, the relationship between the angle of repose θ of the toner and the angle of inclination $\theta_2$ of the end face 72 at the stripping start side and the end face 73 at the stripping end side of developer cartridge 70 will be described hereinbelow with reference to the results of the actual toner charging experiments. For comparison, the results are shown with the two conventional examples: the first having a flat bottom face shown in FIG. 1 and the second having a configuration disclosed in Japanese Utility Model Application Laid-open Hei 6 No.33158 shown in FIG. 2 in which partitions are arranged to divide the interior of the above first cartridge into sections of the same width.

The angle of repose θ of the toner used was 38° and its volume density was 0.3 g/cc. The toner capacity of the developer cartridge in which the toner was filled was 160 g. The angle of inclination $\theta_2$ of the end faces 72 and 73 at the stripping start and end sides of developer cartridge 70 was set at 38°, and the aforementioned amount of toner was charged therein. As illustrated in FIG. 10B, the shift $d_1$ was set at 16 mm, which is termed as model 1 of the present invention.

A model 2 of the present invention was configured almost the same as model 1 except in that the angle of inclination $\theta_2$ of the end faces 72 and 73 at the striping start and end sides of developer cartridge 70 was set at 20°.

A model 3 of the present invention was configured almost the same as model 1 except in that the shift $d_1$ was set at zero, or cartridge 70 shown in FIG. 10A was set.

As described above, each developer cartridge was set to developer storage hopper 50 as shown in FIG. 4 after it was positioned horizontally and shaken five times. In the set positioned, the sealing member was stripped. The result was evaluated by measuring the weight of the toner in each predetermined five equally divided sections (by dividing the length of the cartridge into five equal divisions along the direction of rotary axis 57 of agitator 56). The results of the toner weights for these cartridges are comparatively shown in FIG. 11.

Figure 11:
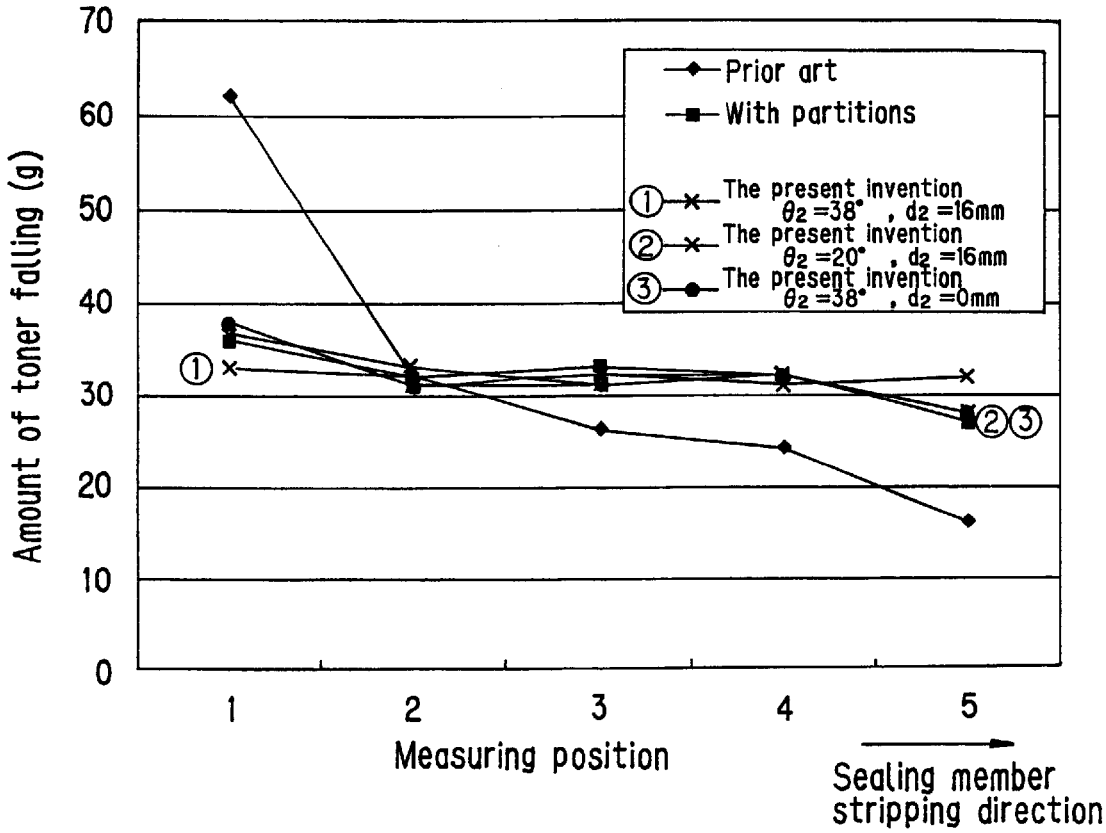
FIG. 11 is a characteristic chart comparatively showing the replenished state of the developer with a developer cartridge of the second embodiment of the present invention and the replenished states of the developer with prior art developer cartridges.

As seen from FIG. 11, it was confirmed that model 1 of the present invention can perform the most perfect developer replenishing. For model 3 of the present invention, a slightly greater amount of developer was charged at the stripping start area while a slightly lowered amount of developer was charged at the stripping end area, just as the conventional developer cartridge with partitions therein. From these results, it is obvious that shifting developer cartridge 70 relative to developer storage hopper 50 in the stripping direction of sealing member 63 to some degree is an effective enough measure.

Also in the case of model 2 of the present invention, the same result was obtained as in the case of model 3 of the present invention. This result shows that stable replenishing can be obtained even if the angle of inclination $\theta_2$ of the end faces 72 and 73 at the stripping start and end sides of developer cartridge 70 is greatly different from the angle of repose θ of toner T. Therefore, in developer cartridge 70, if the angle of inclination $\theta_2$ of the end faces 72 and 73 at the stripping start and end sides is set at 90° or at a value closer thereto, it is possible to regulate the amount of replenishing at the replenishing start point in a manner which can be effective enough when the cartridge 70 is set shifted in the stripping direction of sealing member 63. Accordingly, if the developer cartridge is of a conventional structure shown in FIG. 1, it is possible to regulate the amount of replenishment at the stripping start area and achieve substantially uniform replenishing if the developer cartridge is set to developer storage hopper 50, shifted in the stripping direction of sealing member 63.

Moreover, according to developer cartridges 70 of models 2 and 3 of the present invention, it is possible to replenish the developer substantially uniformly, in the same way as the configuration having partitions therein will do.

Further, according to developer cartridge 70 of the present invention, even if the cartridge is set to developer storage hopper 50 to resupply the toner without being shaken, or after the cartridge has been placed with its stripping start end of sealing member 63 oriented downwards, the amount of toner can be regulated by the inclined end face 72. Therefore, it is possible to inhibit replenishing with an excessive amount of the toner at the stripping start area of sealing member 63 and hence achieve uniform replenishing of the toner. As a result, even if the user forgets to shake developer cartridge 70 before setting it in place, or if such shaking is omitted for simplification, it is possible to achieve uniform replenishing.

In the configuration of developer cartridge 70 of the present invention, since the end faces 72 and 73 at the stripping start and end, alone, are inclined, the cost for the metal die for manufacturing the container box of the cartridge body is almost the same as the conventional configuration, needing no extra manufacturing cost. In contrast, in the case of a configuration having partitions therein, a metal die for forming the partitions is needed or the partitions need to be formed after the manufacture of the container box, hence the manufacturing cost is markedly increased. Moreover, it is necessary to charge each partitioned section with the same amount of toner, so this configuration needs a careful packaging operation. Unless equal filling of the developer in each section can be realized, it is no longer possible to expect stable replenishing as shown in FIG. 11.

As an improvement for the configuration with partitions, Japanese Patent Application Laid-Open Hei 7 No.175035 has proposed a configuration in which passage holes are formed through the partitions in order to make the filled amount in each section equal to others. However, this configuration needs an additional process for forming the passage holes, leading to a rise in cost, as already mentioned above.

In view of the above consideration, the configuration of developer cartridge 70 of the second embodiment of the present invention does not need the above mentioned extra jobs and can be manufactured at almost the same cost as in the conventional configuration. Further, for packaging the developer, there is no need to supply an equal amount of developer for each section, which would be needed for the configuration with partitions. Also the replenishing operation can be as simple as the prior art configuration and hence the present invention is effective in uniform developer replenishing.

In the above description of the present invention, the first and second embodiments have been explained separately, but these embodiments can be combined. For example, in developer cartridge 60 having a configuration shown in FIG.

3, if the packaging amount of toner or the amount of replenishing to developer storage hopper 50 needs to be increased to some degree without increasing the angle of inclination $\theta_1$ of bottom face 64, the end faces 72 and 73 at the stripping start and end may be inclined to some degree in the stripping direction of sealing member 63. In this case, if the angle of inclination $\theta_2$ is set small and hence the changed amount increases, the actual amount of replenishing can be suppressed so as to be low, so that it is possible to make the amount of replenishing uniform as a whole.

According to the developer cartridge of the present invention described heretofore, when the developer packaged therein is charged into the developer storage hopper whilst the sealing member that seals the developer therein being stripped, the developer can be uniformly charged into the hopper across the full length with respect to the stripping direction of the sealing member without causing any excessive charging of the developer at the stripping start area.

Therefore, there is no need to provide partitions, etc., that divide the interior of the container box of the developer cartridge into sections. Therefore, it is possible to provide a developer cartridge of a simple configuration and capable of efficient replenishing of the developer without increasing the manufacturing cost thereof.

Since the angle of repose of the developer to be packaged is considered when estimating the amount of the developer provided, it is possible to realize more stable replenishing of the developer.

What is claimed is:

1. A developer cartridge for holding a developer supplied to a developer storage hopper, comprising:

a container box having an open face which is fitted to a replenishing opening of the developer storage hopper, said container box being substantially filled with the developer; and a sealing member removably bonded to a rim of the opening of the container box to seal the developer in the container box, wherein the container box is detachably set to the developer storage hopper with the sealing member opposed to the replenishing opening of the developer storage hopper, wherein the container box is shaped so that the developer is uniformly supplied from the developer cartridge to the developer storage hopper through the replenishing opening from a stripping start area of the sealing member to a stripping end area of the sealing member along the stripping direction, wherein at least a portion of a first end face of said container box adjacent to the stripping start area is substantially parallel to a second end face of said container box adjacent to said stripping end area and opposed to said first end face, and wherein the container box has a first face opposed to the sealing member and inclined in a first direction so that a height thereof is lowest at the stripping start area of the sealing member, wherein said height gradually increases in the stripping direction.

2. The developer cartridge according to claim 1, wherein an angle of inclination $\theta_1$ of the first face of the container box with respect to the replenishing opening is in the range $$\theta/2 \leqq \theta_1 < \theta,$$

where $\theta$ is the angle of repose of the developer in the developer cartridge.

3. A developer cartridge for holding a developer to be supplied into a developer storage hopper, comprising:

a container box having an opening fitted to a replenishing opening of the developer storage hopper, said container box being substantially filled with the developer; and a sealing member removably bonded to a rim of the opening of the container box to seal the developer in the container box, wherein the container box is detachably set to the developer storage hopper with the sealing member opposed to the replenishing opening of the developer storage hopper, wherein the developer cartridge is fitted to the developer storage hopper with a center of the container box being shifted relative to a center of the developer storage hopper along a stripping direction, wherein at least one end face of the container box forms an acute angle of inclination with respect to the replenishing opening.

4. The developer cartridge according to claim 3, wherein said at least one end face of the container box includes a first end face at the stripping start side of the sealing member and a second end face at the stripping end side of the sealing member, wherein each of the first and second end faces are inclined in the stripping direction of the sealing member at the acute angle of inclination.

5. The developer cartridge according to claim 4, wherein the acute angle of inclination is set substantially equal to an angle of repose of the developer in the container box.

6. The developer cartridge according to claim 5, wherein dimensions of the developer cartridge satisfy the following relationship:

$$d_2 \times \sin \theta_2/2 \leqq d_1 \leqq 3 \times d_2 \times \sin \theta_2/2,$$

wherein $d_1$ is a distance by which the container box is shifted relative to the developer storage hopper in the stripping direction of the sealing member, $d_2$ is the depth of the developer storage hopper, and $\theta_2$ is the acute angle of inclination of the first and second end faces of the container.

7. A developer cartridge for holding a developer supplied to a developer storage hopper, comprising:

a container box having an open face which is fitted to a replenishing opening of the developer storage hopper, said container box being substantially filled with the developer; and a sealing member removably bonded to a rim of the opening of the container box to seal the developer in the container box, wherein the container box is detachably set to the developer storage hopper with the sealing member opposed to the replenishing opening of the developer storage hopper, wherein the container box is shaped so that the developer is uniformly supplied from the developer cartridge to the developer storage hopper through the replenishing opening from a stripping start area of the sealing member to a stripping end area of the sealing member along the stripping direction, wherein at least a portion of a first end face of said container box adjacent to the stripping start area is substantially parallel to a second end face of said container box adjacent to said stripping end area and opposed to said first end face, and wherein the first end face of the container box at the stripping start side of the sealing member and the second end face at the stripping end side of the scaling member are each inclined in the stripping direction of the sealing member.

8. The developer cartridge according to claim 7, wherein an angle of inclination $\theta_2$ of the first and second end faces of the container box are substantially equal to an angle of repose θ of the developer in the developer cartridge.

9. The developer cartridge according to claim 8, wherein dimensions of the developer cartridge satisfy the following relationship:

$$d_2 \times \sin \theta_2/2 \leqq d_1 \leqq 3 \times d_2 \times \sin \theta_2/2,$$

where $d_1$ is the distance by which the container box is shifted relative to the developer storage hopper in the stripping direction, $d_2$ is the depth of the developer storage hopper, and $\theta_2$ is the angle of inclination of the first and second end faces of the container box with respect to the replenishing opening.

10. A developer cartridge for holding a developer supplied to a developer storage hopper, comprising:

a container box having an open face which is fitted to a replenishing opening of the developer storage hopper, said container box being substantially filled with the developer;

a sealing member removably bonded to a rim of the opening of the container box to seal the developer in the container box, wherein the container box is detachably set to the developer storage hopper with the sealing member opposed to the replenishing opening of the developer storage hopper, wherein the container box is shaped so that the developer is uniformly supplied from the developer cartridge to the developer storage hopper through the replenishing opening from a stripping start area of the sealing member to a stripping end area of the sealing member along the stripping direction, wherein at least a portion of a first end face of said container box adjacent to the stripping start area is opposed to a second end face of said container box adjacent to said stripping end area, and wherein a height of the second end face is greater than a height of the first end face; and a bottom face opposed to said replenishing opening, said bottom face being inclined between and connected to said first and said second end faces.

11. The developer cartridge according to claim 10, further comprising a first side face and a second side face opposing each other, wherein said first and second side faces extend between said first and said second end faces along both the replenishing opening and the bottom face, wherein said first and second side faces form a non-perpendicular angle with respect to at least a portion of the bottom face.

12. A developer cartridge for holding a developer supplied to a developer storage hopper, comprising:

a container box having an open face which is fitted to a replenishing opening of the developer storage hopper, said container box being substantially filled with the developer; and a sealing member removably bonded to a rim of the opening of the container box to seal the developer in the container box, wherein the container box is detachably set to the developer storage hopper with the sealing member opposed to the replenishing opening of the developer storage hopper, wherein the container box is shaped so that the developer is uniformly supplied from the developer cartridge to the developer storage hopper through the replenishing opening from a stripping start area of the sealing member to a stripping end area of the sealing member along the stripping direction, wherein at least a portion of a first end face of said container box adjacent to the stripping start area is substantially parallel to a second end face of said container box adjacent to said stripping end area and opposed to said first end face;

a bottom face opposed to said replenishing opening, said bottom face being inclined between and connected to said first and said second end faces; and a first side face and a second side face opposing each other, wherein said first and second side faces extend between said first and said second end faces along both the replenishing opening and the bottom face, wherein said first and second side faces form a non-perpendicular angle with respect to at least a portion of the bottom face.

* * * * *